US006252480B1

(12) United States Patent
Kramer

(10) Patent No.: US 6,252,480 B1
(45) Date of Patent: Jun. 26, 2001

(54) MOVING CONTACT AND CROSSBAR ASSEMBLY FOR A MOLDED CASE CIRCUIT BREAKER

(75) Inventor: Rodney Kramer, Snellville, GA (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 0 days.

(21) Appl. No.: 09/506,755

(22) Filed: Feb. 18, 2000

(51) Int. Cl.[7] ..... H01H 9/00

(52) U.S. Cl. ..... 335/172; 335/16

(58) Field of Search ..... 335/23–25, 6, 335/16, 167–176, 202; 200/293–308, 274–275

(56) References Cited

U.S. PATENT DOCUMENTS

| | | | | |
|---|---|---|---|---|
| 4,594,567 | * | 6/1986 | DiMarco et al. | 335/16 |
| 4,858,056 | * | 8/1989 | Russell | 361/93 |
| 5,270,564 | * | 12/1993 | Parks et al. | 200/401 |
| 5,343,174 | * | 8/1994 | Turner et al. | 335/172 |
| 5,394,126 | * | 2/1995 | Grunert et al. | 335/42 |
| 5,517,164 | * | 5/1996 | Zoller et al. | 335/16 |
| 5,534,835 | * | 7/1996 | McColloch et al. | 335/172 |
| 5,841,616 | * | 11/1998 | Crosier | 361/102 |

* cited by examiner

*Primary Examiner*—Lincoln Donovan

(57) ABSTRACT

The circuit breaker of the present invention is a molded case circuit breaker 10 having a moving contact 42 and crossbar assembly comprising a crossbar 55 having a formation pivotally mounted in the circuit breaker housing 12 with the formation having two spaced apart sidewalls 842, with each sidewall 842 having a first cam surface 830, a cam node 832, a second cam surface 834 and a bearing surface 826. Mounted in the formation, between the sidewalls 842, is a moving contact arm assembly 811 that is mechanically coupled to the circuit breaker operating mechanism 40 and electrically coupled to the load terminal 16 of the circuit breaker 10. The moving contact and crossbar assembly 811 comprises a movable contact arm 45 coupled to a pivot pin 818 positioned between the sidewalls 842 and in rotational contact with a bearing surface 826 of each sidewall 842. The movable contact arm 45 is also provided with a roller pin 812 slidingly mounted in a slot in the arm with the roller pin 812 in operative contact with the first and second cam surfaces 830, 834 of the sidewalls 842. A contact arm pressure spring 816 is coupled to the pivot pin 818 and the roller pin 812 with the contact arm pressure spring 816 providing the force to keep the movable contact arm 45 in the "ON" position. The crossbar and the moving contact arm assembly 811 rotates on a common axis coincident with the pivot pin 818. The movable contact arm 45 has a first end 846 and a second end 847 and includes a first member 45*a* and a second member 45*b*, with each member configured to define an open space 836 between the members at the first end 846 and coupled together at the second end 847. The contact arm pressure spring 816 is mounted within the open space 836 between the two members of the movable contact arm 45. One embodiment of the present invention provides for a one piece crossbar and formation.

15 Claims, 6 Drawing Sheets

MOVING CONTACT AND CROSSBAR ASSEMBLY FOR A MOLDED CASE CIRCUIT BREAKER

FIELD OF THE INVENTION

The present invention relates generally to the field of circuit breakers, and more particularly to a moving contact and crossbar assembly for a molded case circuit breaker.

BACKGROUND OF THE INVENTION

In general the function of a circuit breaker is to electrically engage and disengage a selected circuit from an electrical power supply. This function occurs by engaging and disengaging a pair of operating contacts for each phase of the circuit breaker. The circuit breaker provides protection against persistent overcurrent conditions and against the very high currents produced by short circuits. Typically, one of each pair of the operating contacts are supported by a pivoting contact arm while the other operating contact is substantially stationary. The contact arm is pivoted by an operating mechanism such that the movable contact supported by the contact arm can be engaged and disengaged from the stationary contact.

There are two modes by which the operating mechanism for the circuit breaker can disengage the operating contacts: the circuit breaker operating handle can be used to activate the operating mechanism; or a tripping mechanism, responsive to unacceptable levels of current carried by the circuit breaker, can be used to activate the operating mechanism. For many circuit breakers, the operating handle is coupled to the operating mechanism such that when the tripping mechanism activates the operating mechanism to separate the contacts, the operating handle moves to a fault or tripped position.

To engage the operating contacts of the circuit breaker, the circuit breaker operating handle is used to activate the operating mechanism such that the movable contact(s) engage the stationary contact(s). A motor coupled to the circuit breaker operating handle can also be used to engage or disengage the operating contacts. The motor can be remotely operated.

A typical industrial circuit breaker will have a continuous current rating ranging from as low as 15 amps to as high as several thousand amps. The tripping mechanism for the breaker usually consists of a thermal overload release and a magnetic short circuit release. The thermal overload release operates by means of a bimetalic element, in which current flowing through the conducting path of a circuit breaker generates heat in the bi-metal element, which causes the bi-metal to deflect and trip the breaker. The heat generated in the bi-metal is a function of the amount of current flowing through the bi-metal as well as the period of time that that current is flowing. For a given range of current ratings, the bi-metal cross- section and related elements are specifically selected for such current range resulting in a number of different current ranges for each circuit breaker. Electronic trip units are also used in some applications.

In the event of current levels above the normal operating level of the thermal overload release, it is desirable to trip the breaker without any intentional delay, as in the case of a short circuit in the protected circuit, therefore, an electromagnetic trip element is generally used. In a short circuit condition, the higher amount of current flowing through the circuit breaker activates a magnetic release which trips the breaker in a much faster time than occurs with the bi-metal heating. It is desirable to tune the magnetic trip elements so that the magnetic trip unit trips at lower short circuit currents at a lower continuous current rating and trips at a higher short circuit current at a higher continuous current rating. This matches the current tripping performance of the breaker with the typical equipment present downstream of the breaker on the load side of the circuit breaker. Again, electronic trip units can also be used. Because of the higher voltages and currents that must be interrupted, there is potential for damage to the components of a circuit breaker from the hot by-products of the electric arc interruption. During an electrical interruption, both gasses and small molten metallic particles are generated and expand outward from the electrical contacts into the arc chamber area of the circuit breaker. One component of a circuit breaker that is particularly vulnerable to damage from arc exhaust is the contact pressure spring which biases the movable contact arm in its closed, "ON," position. If the spring is exposed to too much heat, this may cause annealing and the spring can lose tension. This could result in the spring's inability to close the contact arm after a fault current event.

Another problem occurs in circuit breakers subject to high continuous current ratings. In a circuit breaker that is subject to high current, the overall size of the breaker must be larger in order to accommodate conductors with a larger cross section. This means that the crossbar must be longer. In addition, because greater pressure is required to maintain the contacts, the movable contact and the stationary contact, in a closed position a greater force is transmitted to the crossbar. Because of the longer length and the greater forces on the crossbar, the crossbar has a tendency to flex or bow along its length when the circuit breaker is "ON" and the contacts are closed. In such situations, the crossbar flexes but the contact arm pivot remains stationary. As a result, the geometric relationship between the surfaces of the crossbar and the contact arm change which changes the amount of torque applied to the contact arm by the crossbar during normal operation or in a overload condition. Therefore, flexing of the crossbar can cause an unacceptable amount of variation in the pressure that must be applied to the contact arms to maintain the proper mechanical and electrical coupling with the contacts.

Thus, there is a need for a molded case circuit breaker that will protect a contact arm pressure spring from arc gases and debris and that works throughout a broad range of current readings with a minimum of unique parts and manufacturing tools. Further there is a need for a molded case circuit breaker that minimizes or eliminates the geometric changes between the crossbar and the contact arm pivot. There is an additional need for a molded case circuit breaker in which the force needed to reset the breaker does not have to overcome the spring force that maintains the movable contact arms in the "ON" position. There is a further need for a molded case circuit breaker that can be easily reconfigured over a broad range of current ratings by utilizing interchangeable parts and additional parts with a minimum of unique parts.

SUMMARY OF THE INVENTION

The circuit breaker of the present invention is a molded case circuit breaker having a moving contact and crossbar assembly comprising a crossbar having a formation pivotally mounted in the circuit breaker housing with the formation having two spaced apart sidewalls, with each sidewall having a first cam surface, a cam node, a second cam surface and a bearing surface. Mounted in the formation, between the sidewalls, is a moving contact arm assembly that is mechanically coupled to the circuit breaker operating mechanism and electrically coupled to the load terminal of the circuit breaker. The moving contact and crossbar assembly comprises a movable contact arm coupled to a pivot pin positioned between the sidewalls and in rotational contact with a bearing surface of each sidewall. The movable contact arm is also provided with a roller pin slidingly mounted in a slot in the arm with the roller pin in operative contact with the first and second cam surfaces of the sidewalls. A contact arm pressure spring is coupled to the pivot pin and the roller pin with the contact arm pressure spring providing the force to keep the movable contact arm in the "ON" position. The crossbar and the moving contact arm assembly rotates on a common axis coincident with the pivot pin. The movable contact arm has a first end and a second end and includes a first member and a second member, with each member configured to define an open space between the members at the first end and coupled together at the second end. The contact arm pressure spring is mounted within the open space between the two members of the movable contact arm and the load contact pad is mounted on the second end of the movable contact arm. The pivot pin and the roller pin are mounted traverse to the two members of the movable contact arm. A load contact is mounted on the second end of the movable contact arm. One embodiment of the present invention provides for a one piece crossbar and formation. Another embodiment of the present invention provides for multiple formations mounted on the crossbar configured in a multi-pole circuit breaker. An additional embodiment of the present invention provides for the crossbar and multiple formations to be one piece.

The present invention also provides a molded case circuit breaker comprising a molded housing including a breaker cover, a first terminal and a second terminal mounted in the housing with a contact electrically coupled to the first terminal. An operating mechanism having a pivoting member movable between an "ON" position, an "OFF" position and a "TRIPPED" position. An intermediate latching mechanism mounted in the housing and coupled to the operating mechanism selectively engaged by a trip mechanism coupled selectively to the operating mechanism and electrically connected to the second terminal. A moving contact and crossbar assembly is coupled to the second terminal and the pivoting member. The moving contact and crossbar assembly comprises a crossbar having a formation pivotally mounted in the housing, with the formation having two spaced apart sidewalls, with each sidewall having a first cam surface, a cam node, a second cam surface and a bearing surface with a moving contact arm assembly mounted in the formation and mechanically coupled to the operating mechanism and electrically coupled to the second terminal. The moving contact arm assembly comprises a pivot pin positioned between the sidewalls and in rotational contact with the bearing surface of each sidewall with the movable contact arm coupled to the pivot pin and positioned between the sidewalls. A roller pin is slidingly mounted in a slot in the movable contact arm with the roller pin in operative contact with the first and second cam surfaces and the cam node of each sidewall. A contact arm pressure spring is coupled to the pivot pin and the roller pin and provides the pressure force to maintain the movable contact arm in the "ON" position. The crossbar and the moving contact arm assembly rotates on a common axis coincident with the pivot pin. The movable contact arm has a first end and a second end and includes a first member and a second member, with each member configured to define an open space between the members at the first end and coupled together at the second end. The contact arm pressure spring is mounted within the open space between the two members of the movable contact arm. The pivot pin and the roller pin are mounted traverse to the two members of the movable contact arm. A load contact is mounted on the second end of the movable contact arm. One embodiment of the present invention provides for a one piece crossbar and formation. Another embodiment of the present invention provides for multiple formations mounted on the crossbar configured in a multi-pole circuit breaker. An additional embodiment of the present invention provides for the crossbar and multiple formations to be one piece.

DETAILED DESCRIPTION OF THE PREFERRED EMBODIMENTS

Figure 1:
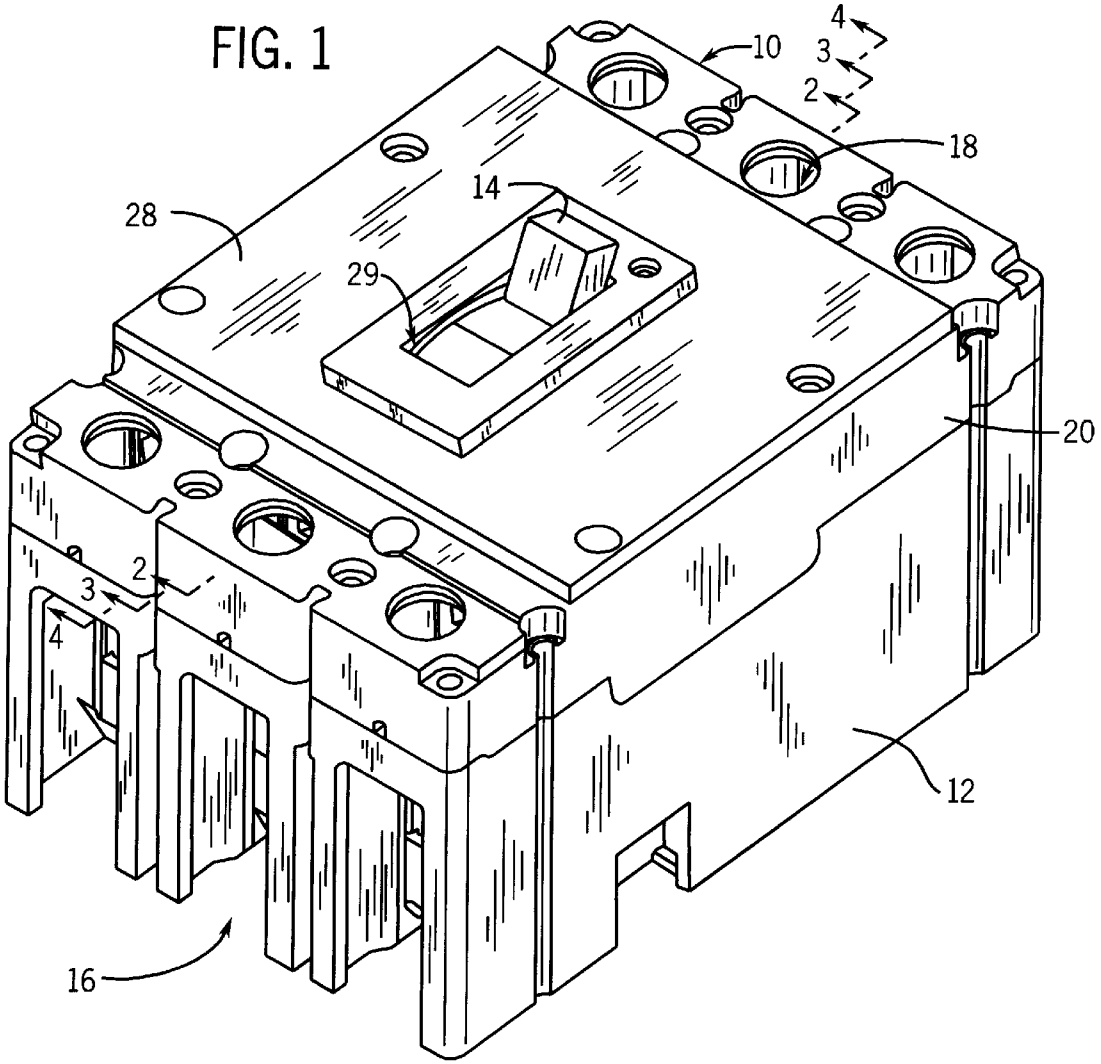
FIG. 1 is an isometric drawing of a molded case circuit breaker which includes an embodiment of the present having contact and crossbar assembly.

FIG. 1 generally illustrates a three phase molded case circuit breaker 10 of the type which includes an operating mechanism 40 having a pivoting member 13 with a handle 14. The pivoting member 13 and handle 14 are moveable between an "ON" position, an "OFF" position and a "TRIPPED" position. The exemplary circuit breaker 10 is a three pole breaker having three sets of contacts for interrupting current in each of the three respective electrical transmission phases. In the exemplary embodiment of the invention, each phase includes separate breaker contacts and a separate trip mechanism. The center pole circuit breaker includes an operating mechanism which controls the switching of all three poles of the breaker. Although an embodiment of the present invention is described in the context of the three phase circuit breaker, it is contemplated that it may be practiced in a single phase circuit breaker or in other multi-phase circuit breakers.

Figure 2:
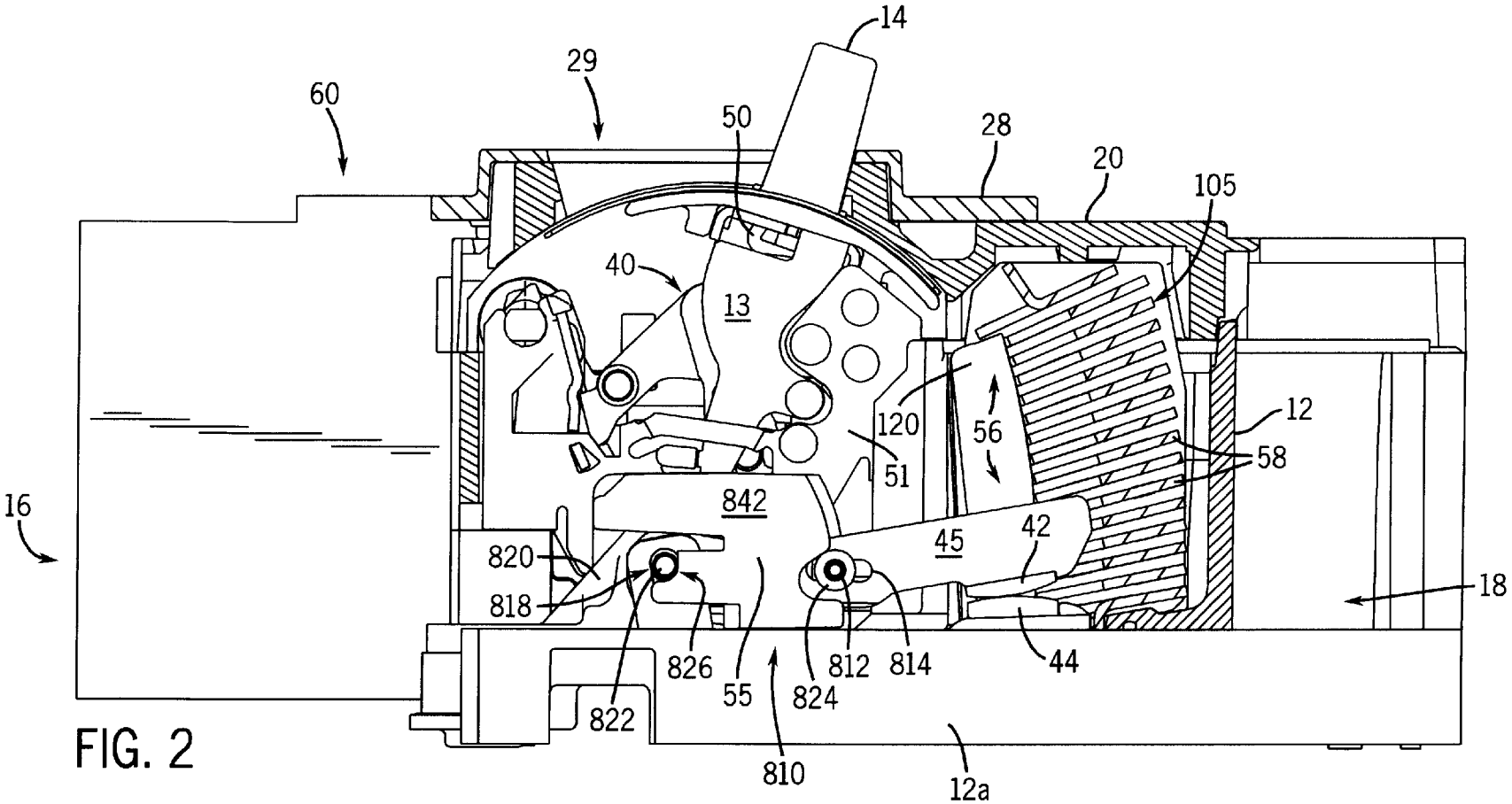
FIG. 2 is a section view of the circuit breaker shown in FIG. 1 along the lines 2—2 illustrating an example of the moving contact and crossbar assembly.

Referring to FIG. 2., handle 14 is operable between the "ON" and "OFF" positions to enable a contact operating mechanism 40 to engage and disengage a moveable contact 42 and a stationary contact 44 for each of the three phases, such that the line terminal 18 and load terminal 16 of each phase can be electrically connected. The circuit breaker housing 12 includes three portions which are molded from an insulating material. These portions include a circuit breaker base 12, a sub-base 12*a*, a main circuit breaker cover 20 and an accessory cover 28, with the main breaker cover 20 and the accessory cover 28 having an opening 29 for the handle 14 of the pivoting member 13. The pivoting member 13 and handle 14 move within the opening 29 during the several operations of the circuit breaker 10. FIG. 2 is a cut away view of the circuit breaker 10 along the lines 2—2 shown in FIG. 1. As shown in FIG. 2, the main components of the circuit breaker are a fixed line contact arm (not shown) and a moveable load contact arm 45. It should be noted that another embodiment of the circuit breaker 10 has a movable line contact arm to facilitate a faster current interruption action. The load contact arms for each of the three phases of the exemplary breaker are mechanically connected together by an insulating cross bar member 55. This cross bar member 55, in turn, is mechanically coupled to the operating mechanism 40 so that, by moving the handle 14 from left to right, the cross bar 55 rotates in a clockwise direction and all three load contact arms 45 are concurrently moved to engage their corresponding line contact arms thereby making electrical contact between moveable contact pad 42 and stationary contact pad 44.

Figure 3:
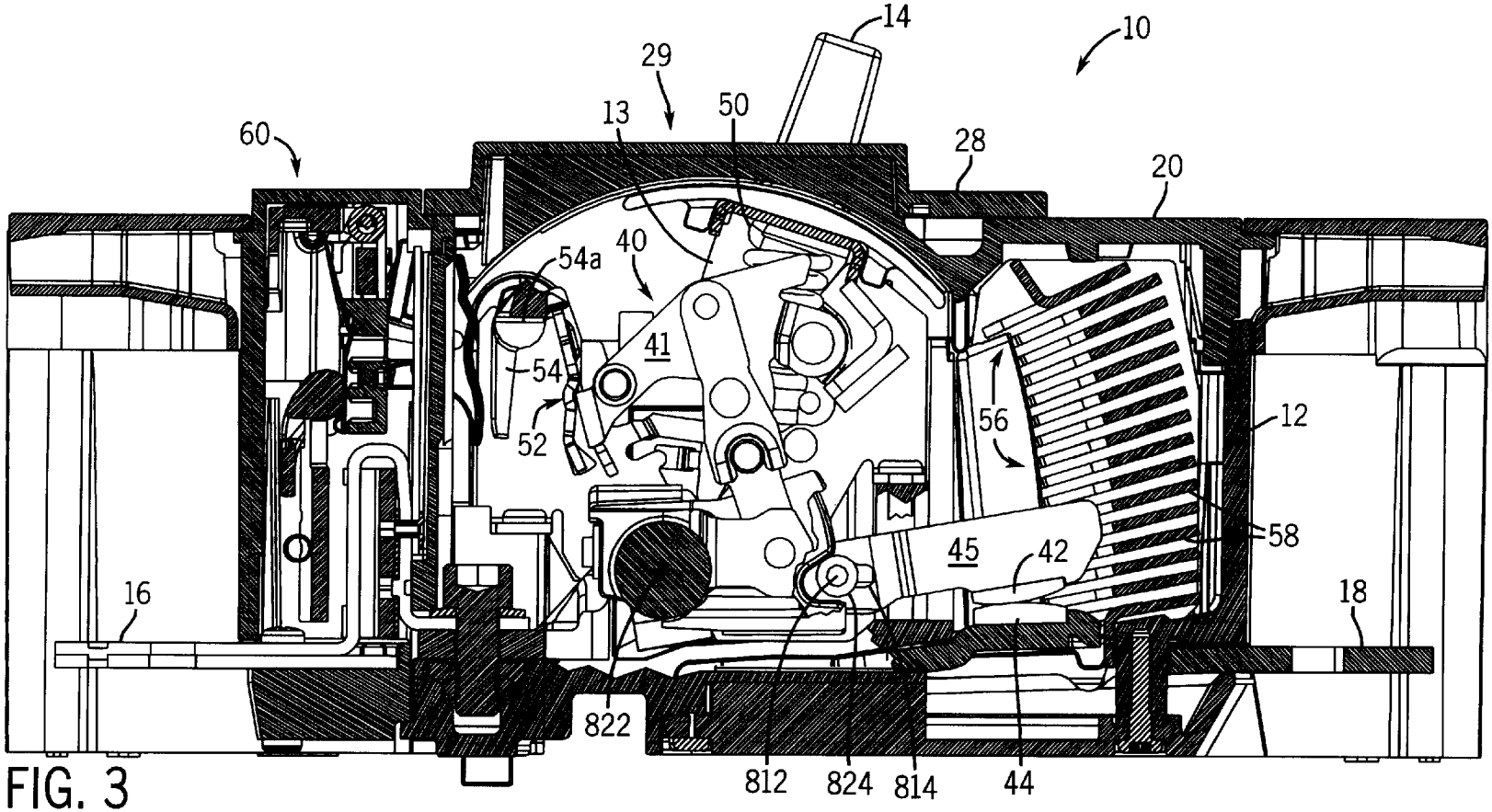
FIG. 3 is a section view of the circuit breaker show in FIG. 1 along lines 3—3 illustrating an example of the moving contact and crossbar assembly between formations mounted on the crossbar and illustrating the torque transmitting section of the crossbar between poles.
Figure 4:
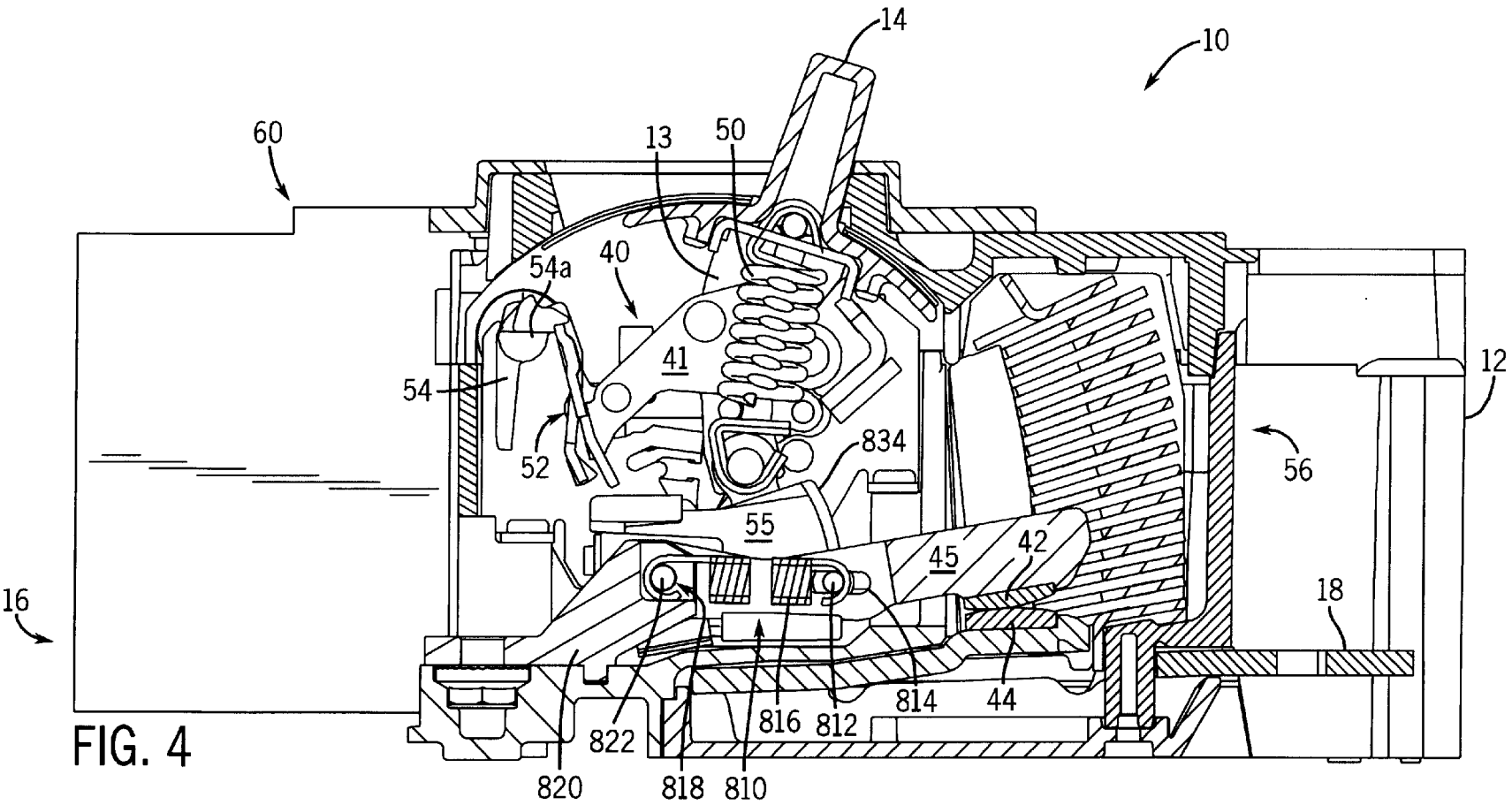
FIG. 4 is a sectional view of the circuit breaker shown in FIG. 1 along the lines 4—4 illustrating an example of the moving contact and crossbar assembly within a formation mounted on a crossbar, showing the contact arm pressure spring mounted on the roller pin and the pivot pin of the moving contact arm assembly with the axis of rotation of the movable contact arm and a crossbar in common and "coincident" with the pivot pin.

Referring to FIGS. 2–4 the operating mechanism 40 includes a cradle 41 which engages an intermediate latch 52 to hold the contacts of the circuit breaker in a closed position unless and until an over current condition occurs, which causes the circuit breaker to trip. A portion of the moveable contact arm 45 and the stationary contact bus are contained in an arc chamber 56. Each pole of the circuit breaker 10 is provided with an arc chamber 56 which is constructed from an insulating material and is part of the circuit breaker 10 housing 12. A plurality of arc plates 58 are maintained in the arc chamber 56. The arc plates facilitate the extension and cooling of the arc formed when the circuit breaker 10 is opened while under a load and drawing current. The arc chamber 56 and arc plates 58 direct the arc away from the operating mechanism 40.

The exemplary intermediate latch 52 is generally Z-shaped having one leg which includes a latch surface that engages the cradle 41 and another leg having a latch surface which engages a trip bar 54. The center portion of the Z-shaped intermediate latch element 52 is angled with respect to the two legs and includes two tabs which provide a pivot edge for the intermediate latch 52 when it is inserted into the mechanical frame 51. The intermediate latch 52 is typically coupled to a torsion spring which is retained in the mechanical frame 51 by the mounting tabs of the intermediate latch 52. The torsion spring biases the lower latch surface of the intermediate latch 52 toward the cradle 41 while at the same time biasing the trip bar 54 into a position which engages the upper latch surface of the intermediate latch 52. The trip bar 54 pivots in a counter clockwise direction about an axis 54*a*, responsive to a force exerted by a trip mechanism 60, during, for example, a long duration over current condition. As the trip bar 54 rotates, in a counter clockwise direction, the latch surface on the upper portion of the trip bar disengages the latch surface on the upper portion of the intermediate latch 52. When this latch surface of the intermediate latch 52 is disengaged, the intermediate latch 52 rotates in a counter clockwise direction under the force of the operating mechanism 40, exerted through a cradle 41. In the exemplary circuit breaker, this force is provided by a tension spring 50. Tension is applied to the spring when the breaker toggle handle 14 is moved from the open position to the closed position. More than one tension spring 50 may be utilized.

As the intermediate latch 52 rotates responsive to the upward force exerted by the cradle 41, it releases the latch on the operating mechanism 40, allowing the cradle 41 to rotate in a clockwise direction. When the cradle 41 rotates, the operating mechanism 40 is released and the cross bar 55 rotates in a counter clockwise direction to move the load contact arms 45 away from the line contact 44.

During normal operation of the circuit breaker, current flows from the line terminal 18 through the line contact arm and its stationary contact pad 44 to the load contact arm 45 through its contact pad 42. From the load contact arm 45, the current flows through a coupler, such as a flexible braid, a pivot terminal 820 or other suitable and convenient connection, to the trip mechanism 60 and from the trip mechanism 60 to the load terminal 16. When the current flowing through the circuit breaker exceeds the rated current for the breaker, the trip mechanism 60 engages the trip bar 54. As the trip mechanism engages the trip bar surface and continues to bend, it causes the trip bar 54 to rotate in a counter clockwise direction releasing the intermediate latch 52 and thus unlatching the operating mechanism 40 of the circuit breaker.

The load contact arm 45 as well as the contact arms for the other poles, are fixed in position on the cross bar element 55. As mentioned above, additional poles, such as a four pole molded case circuit breaker can utilize the same construction as described herein, with the fourth pole allocated to a neutral. The load contact arm 45 is coupled to the trip mechanism 60 by a conductor (e.g. braided copper strand or pivot terminal). Current flows from the conductor through the trip mechanism 60 to a connection which couples the current to the load terminal 16 through a load bus. The load bus is supported by a load bus support mounted in the housing 12.

In the exemplary circuit breaker 10, the cross bar 55 is coupled to the operating mechanism 40, which is held in place in the base or housing 12 of the molded case circuit breaker 10 by a mechanical frame. The key element of the operating mechanism 40 is the cradle 41. The cradle 41 includes a latch surface which engages the lower latch surface in the intermediate latch 52. The intermediate latch 52 is held in place by its mounting tabs which extend through the respective openings on either side of the mechanical frame 51. In the exemplary embodiment of the circuit breaker, the two side members of the mechanical frame 51 support the operating mechanism 40 of the circuit breaker 10 and retain the operating mechanism 40 in the base 12 of the circuit breaker 10.

The breaker cover 20, in the preferred embodiment, has two accessory sockets formed in the cover 20, with one accessory socket on either side of the opening 29 for the pivoting member 13 and handle 14. The breaker cover 20 with the accessory sockets or compartments can be formed, usually by well known molding techniques, as an integral unit. The accessory socket can also be fabricated separately and attached to the breaker cover 20 by any suitable method such as with fasteners or adhesives. The breaker cover 20 is sized to cover the operating mechanism 40, the moveable contact 42 and the stationary contact 44, as well as the trip mechanism 60 of the circuit breaker 10. The breaker cover has an opening 29 to accommodate the handle 14. Another embodiment of the circuit breaker provides a separate housing for the trip mechanism 60.

Each accessory socket or compartment is provided with a plurality of openings. The accessory socket openings are positioned in the socket to facilitate coupling of an accessory with the operating mechanism 40 mounted in the housing 12. The accessory socket openings also facilitate simultaneous coupling of an accessory with different parts of the operating mechanism. Various accessories can be mounted in the accessory compartment to perform various functions. Some accessories, such as a shunt trip, will trip the circuit breaker 10, upon receiving a remote signal, by pushing the trip bar 54 in a counter clockwise direction causing release of the mechanism latch 52 of the operating mechanism 40. Another accessory, such as an auxiliary switch, provides a signal indicating the status of the circuit breaker 10, e.g. "ON" or "OFF". Multiple devices can be nested in one accessory socket and each device can engage the operating mechanism through a different opening in the socket.

Figure 5:
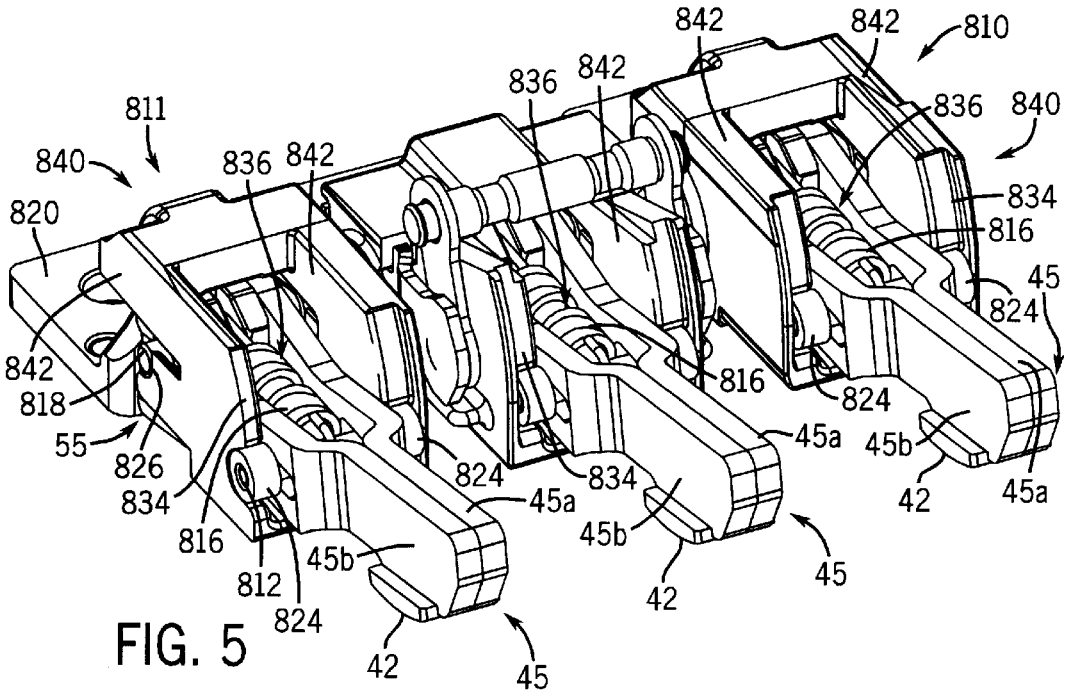
FIG. 5 is an isometric drawing of an example of a moving contact and crossbar assembly of the multi-pole molded case circuit breaker, with the movable contact arms in the closed ("ON") position.
Figure 6:
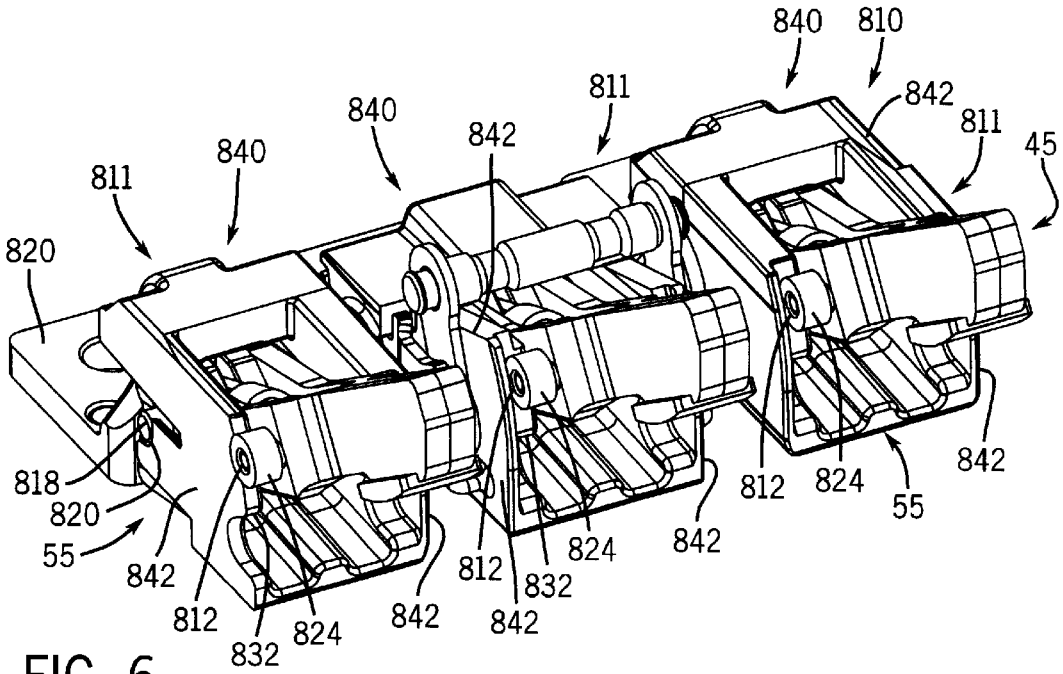
FIG. 6 is an isometric drawing of an example of the moving contact and crossbar assembly shown in FIG. 5 with the movable contact arms in the "OPEN" position.
Figure 7:
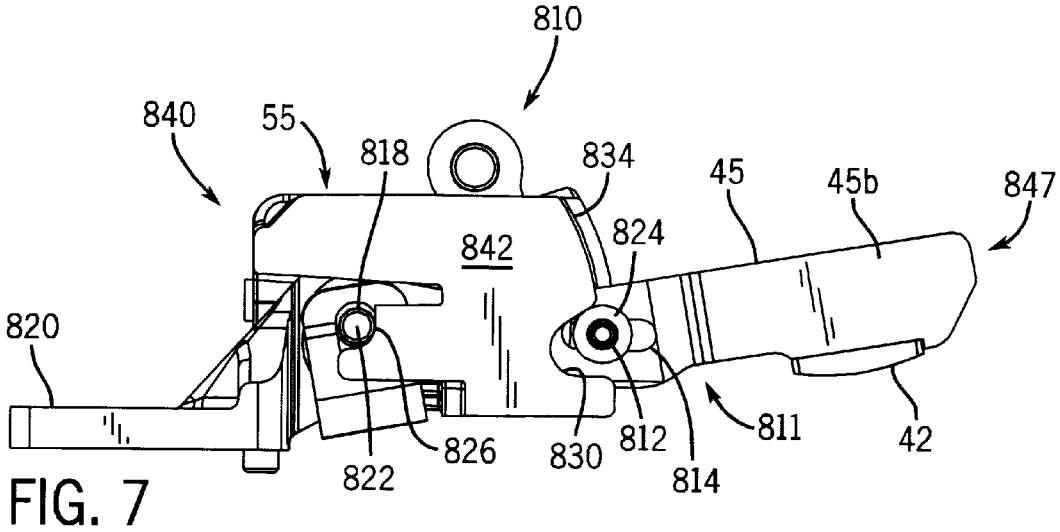
FIG. 7 is a side plan view of the moving contact and crossbar assembly illustrated in FIG. 5.
Figure 8:
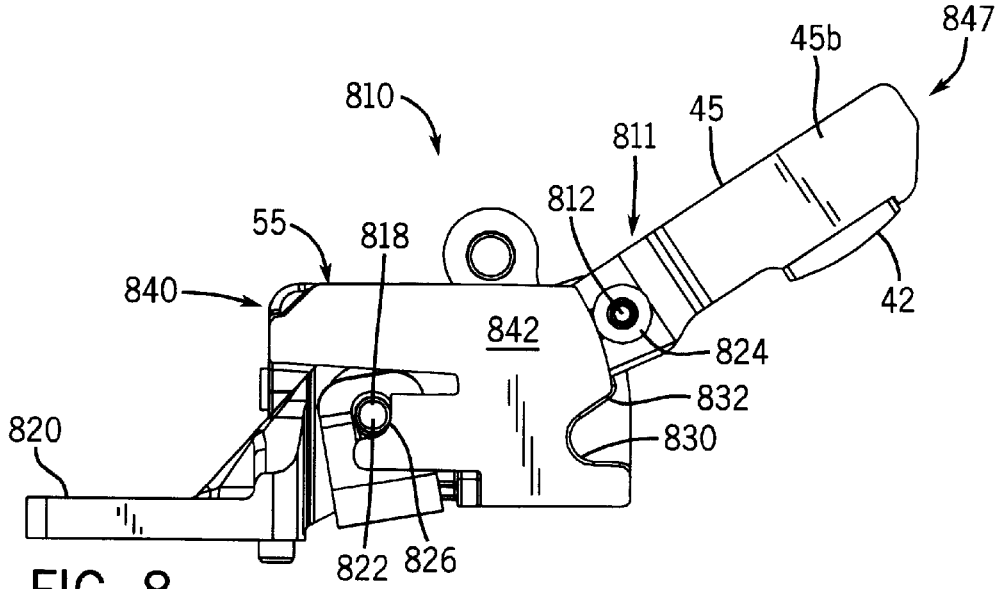
FIG. 8 is a side plan view of an example of the moving contact and crossbar assembly illustrated in FIG. 6

FIGS. 5 to 8 illustrate a moving contact and crossbar assembly 811 for a molded case circuit breaker. The crossbar 55 is provided with a formation 840 with the crossbar 55 pivotally mounted in the housing 12. The crossbar pivots along a horizontal axis 822. The formation 840 is formed by two spaced apart sidewalls 842 with each sidewall 842 having a first cam surface 830, a cam node 832, a second cam surface 834 and a bearing surface 826. In one embodiment, the formation is formed in one piece and typically can be molded or machined in the configuration as best seen in FIG. 5. FIGS. 5 and 6 illustrate a multi-pole moving contact and crossbar assembly. It should be understood that the moving contact and bar assembly 811 can also be used in a single pole or two pole circuit breaker or in a four pole circuit breaker with the fourth pole being designated a "neutral." The crossbar 55 and formation 840 are coupled to or mounted to the terminal 820 which is coupled to the load terminal 16 through the trip mechanism 60. The coupling can occur with a flexible braid or with a solid conductor. It is also contemplated that the trip mechanism 60 is housed in a separate housing and mechanically and electrically connected to the circuit breaker housing 12.

Mounted in each formation 840 is a moving contact arm assembly 811 that is mechanically coupled through the crossbar 55 to the operating mechanism 40 and electrically coupled to the load terminal 16 as described above. The moving contact arm assembly 811 comprises a pivot pin 818 positioned between the sidewalls 842 and is in rotational contact with the bearing surface 826 of each sidewall 842. The pivot pin is aligned with the rotational axis 822 of the crossbar 55 and extends traverse to each sidewall 842. A movable contact arm 45 is coupled to the pivot pin 818 and positioned between the sidewalls 842 with the movable contact arm 45 provided with a slot 814 and a load contact 42. A roller pin 812 is slidingly mounted in the slot 814 traverse to the movable contact arm 45 and is in operative contact with the first and second cam surfaces 830, 834 and the cam node 832 of each sidewall 842. A contact arm pressure spring 816 is coupled between the pivot pin 818 and the roller pin 812 (see FIG. 4). The contact arm pressure spring 816 provides the force that maintains the contact arm 45 in the "ON" position.

In operation, the movable contact arm 45 is maintained in position by the contact arm pressure spring 816 pulling the pivot pin 818 against the bearing surface 826 of each sidewall 842. As the contact arm 45 moves from the "ON" position to the "OFF" position, it is guided by a roller 824 mounted on each end of the roller pin 812 as the roller 824 travels along the first cam surface 830, the cam node 832 and the second cam surface 834. The cam surfaces, 830, 834 allow precise tuning of the torques applied to the contact arm 45 by the crossbar 55 during their operation. A higher torque is required when the contacts 42, 44 are closed. As the contact arm 45 blows open under a fault condition, the torque reduces to a lower level to facilitate rapid opening of the contacts 42, 44 as the rollers 824 move along the cam surfaces. During the fault condition, the contact arm 45 opens first and a short time later, the operating mechanism 40 will trip and pull the crossbar 55 to the open position. The crossbar 55 rotates along an axis 822 which is in common with the rotational pivot axis of the contact arm 45 and is coincident with the pivot pin 818. With the crossbar 55 and the movable contact arm 45 rotating about the same rotational axis 822, the force needed, during the reset of the operating mechanism 40 of the circuit breaker 10, to over come the bias force of the spring 50 does not have to also overcome the spring force of the contact arm 45 as provided by the contact arm pressure spring 816. As a result the spring forces for the contact arm 45 can be designed without regard to the spring force of the toggle reset thereby providing a much finer design opportunity. Further, with the crossbar 55 and the moving contact arm 45 rotating about a common axis 822, a more precise spring force control is available.

Another embodiment of the moving contact and crossbar assembly 811 provides a movable contact arm 45 that has a first end 846 and a second end 847. The contact arm 45 includes a first member 45a and a second member 45*b* with each member configured to define an open space 836 between the members at the first end 846 of the contact arm 45. The two members 45*a* and 45*b* are coupled together at the second end 847 and provide a mounting area for the load contact 42. The coupling of the two members 45*a* and 45*b* can be in any convenient manner such as by welding, brazing, soldering, riveting, etc. As best seen in FIGS. 5 and 6, the contact arm pressure spring 816 is mounted within the open space 836 of each contact arm 45. As mentioned above, the contact arm pressure spring 816 is susceptible to damage by gasses and metallic particles generated during the opening of the contacts 42, 44 especially under a fault condition. By mounting the contact arm pressure spring 816 between the two members 45*a* and 45*b* of the contact arm 45 a reduction in the likelihood of damage to the spring is realized. The two members of the contact arm 45 provide lateral protection for the spring 816 with additional protection being provided by the crossbar 55 itself as the crossbar rotates about its rotational axis 822.

In the preferred embodiment of the moving contact and crossbar assembly 811, the crossbar 55 and the formation 840 are formed as one piece. The one piece can be molded or machined from any suitable material that will provide the necessary electrical and mechanical characteristics for the application in which the circuit breaker 10 will be applied. In the multi-pole configuration of the moving contact and crossbar assembly 811, all formations 840 (one formation for each pole) and the crossbar 55 are formed as one piece.

In another embodiment of the molded case circuit breaker 10, the trip mechanism 60 and the load terminal 16 are contained in a separate housing with the operating mechanism 40 intermediate latch 52 and the line terminal 18 contained in a second housing. The cover 20 can be configured to cover both housings or the cover 20 can also be in two parts with each part covering a respective separate housing of the circuit breaker 10. Another embodiment of the molded case circuit breaker further comprises an accessory socket formed in the breaker cover 20 on either side of the opening 29 for the pivoting member 13 with the accessory socket in communication with the housing 12 and configured to accept a plurality of different types of accessories 80. An accessory cover 28 is sized to cover an accessory mounted in the accessory socket.

While the embodiments illustrated in the figures and described above are presently preferred, it should be understood that these embodiments are offered by way of example only. Invention is not intended to be limited to any particular embodiment, but it is intended to extend to various modifications that nevertheless fall within the scope of the intended claims. For example it is also contemplated that the trip mechanism having a bi-metal trip unit or an electronic trip unit with a load terminal be housed in a separate housing capable of mechanically and electrically connected to another housing containing the operating mechanism and line terminal thereby providing for a quick and easy change of current rating for an application of the circuit breaker contemplated herein. Modifications will be evident to those with ordinary skill in the art.

What is claimed is:

1. A moving contact and crossbar assembly for a molded case circuit breaker, the circuit breaker having a housing, an operating mechanism including an intermediate latch, a trip mechanism, a handle, a line terminal, a load terminal and a cover, the moving contact and crossbar assembly comprising:

a crossbar having a formation pivotally mounted in the housing, with the formation having two spaced apart sidewalls, with each side wall having a first cam surface, a cam node, a second cam surface and a bearing surface; and, a moving contact arm assembly mounted in the formation and mechanically coupled to the operating mechanism and coupled to the load terminal, with the moving contact arm comprising:

a first end and a second end and includes a first member and a second member, with each member configured to define an open space between the members at the first end and coupled together at the second end, wherein a contact arm pressure spring is coupled to the pivot pin and the roller pin within the open space and a load contact is mounted on the second end;

a pivot pin positioned between the sidewalls and in rotational contact with the bearing surface of each side wall;

a slot provided in the movable contact arm, with the movable contact arm positioned between the sidewalls and coupled to the pivot pin; and, a roller pin slidingly mounted in the slot and in operative contact with the first and second cam surfaces and the cam node of each side wall.

2. The moving contact and crossbar assembly of claim 1, wherein the crossbar and the moving contact arm assembly rotates on a common axis coincident with the pivot pin.

3. The moving contact and crossbar assembly of claim 3, wherein the roller pin supports a roller, with the roller moving along the cam surfaces as the movable contact arm moves from one position to another position.

4. The moving contact and crossbar assembly of claim 3, wherein the crossbar supports at least one additional formation having an additional moving contact arm assembly mounted in the additional formation configured in a multi-pole circuit breaker.

5. The moving contact and crossbar assembly of claims 4, wherein the cross bar and each formation are one piece.

6. The moving contact and crossbar assembly of claims 1, wherein the cross bar and each formation are one piece.

7. A molded case circuit breaker comprising:

a molded housing including a breaker cover;

a first terminal and a second terminal mounted in the housing;

a contact electrically coupled to the first terminal;

an operating mechanism having a pivoting member moveable between an "ON" position, an "OFF" position and a "TRIPPED" position;

an intermediate latching mechanism mounted in the housing and coupled to the operating mechanism;

a trip mechanism coupled selectively coupled to the operating mechanism and electrically connected to the second terminal; and, a moving contact and crossbar assembly coupled to the second terminal and the pivoting member of the operating mechanism, the moving contact and crossbar assembly comprising:

a crossbar having a formation pivotally mounted in the housing, with the formation having two spaced apart sidewalls, with each side wall having a first cam surface, a cam node, a second cam surface and a bearing surface; and, a moving contact arm assembly mounted in the formation and mechanically coupled to the operating mechanism and coupled to the second terminal, with the moving contact arm comprising:

a first end and a second end and includes a first member and a second member, with each member configured to defme an open space between the members at the first end and coupled together at the second end, wherein a contact arm pressure spring is coupled to the ipivot pin and the roller pin within the open space and a load contact is mounted on the second end;

a pivot pin positioned between the sidewalls and in rotational contact with the bearing surface of each side wall;

a slot provided in the movable contact arm, with the movable contact arm positioned between the sidewalls and coupled to the pivot pin; and, a roller pin slidingly mounted in the slot and in operative contact with the first and second cam surfaces and the cam node of each side wall.

8. The molded case circuit breaker of claim 7, wherein the crossbar and the moving contact arm assembly rotates on a common axis coincident with the pivot pin.

9. The molded case circuit breaker assembly of claim 7, wherein the roller pin supports a roller, with the roller moving along the cam surface as the movable contact arm moves from one position to another position.

10. The molded case circuit breaker of claim 7, wherein the crossbar supports at least one additional formation having an additional moving contact arm assembly mounted in the additional formation configured in a multi-pole circuit breaker.

11. The molded case circuit breaker of claims 10, wherein the cross bar and each formation are one piece.

12. The molded case circuit breaker of claims 7, wherein the cross bar and each formation are one piece.

13. The molded case circuit breaker of claim 7, wherein the circuit breaker housing comprises at least two parts, with one part having the operating mechanism, intermediate latch, and first terminal, and another part having the second terminal and the trip mechanism, with the cover extending over each part.

14. The molded case circuit breaker of claim 13, wherein the two parts of the housing are selectively separable.

15. The molded case circuit breaker of claim 8, further comprising:

an accessory socket formed in the breaker cover on either side of an opening for the pivoting member, with the accessory socket in communication with the housing and configured to accept a plurality of different types of accessories; and, an accessory cover sized to cover an accessory mounted in the accessory socket.

* * * * *